US006761218B2

(12) United States Patent
Nguyen et al.

(10) Patent No.: US 6,761,218 B2
(45) Date of Patent: Jul. 13, 2004

(54) METHODS AND APPARATUS FOR IMPROVING PERFORMANCE OF GRAVEL PACKING SYSTEMS

(75) Inventors: Philip D. Nguyen, Duncan, OK (US); Jimmie D. Weaver, Duncan, OK (US); Mike W. Sanders, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/113,499

(22) Filed: Apr. 1, 2002

(65) Prior Publication Data

US 2003/0183387 A1 Oct. 2, 2003

(51) Int. Cl.[7] ..... E21B 43/04
(52) U.S. Cl. ..... 166/278; 166/51; 166/308
(58) Field of Search ..... 166/276, 278, 166/51, 378, 308, 227, 229, 230, 236, 233

(56) References Cited

U.S. PATENT DOCUMENTS

| | | | | | |
|---|---|---|---|---|---|
| 4,733,729 | A | * | 3/1988 | Copeland | 166/276 |
| 4,945,991 | A | * | 8/1990 | Jones | 166/278 |
| 5,165,476 | A | * | 11/1992 | Jones | 166/278 |
| 5,269,375 | A | * | 12/1993 | Schroeder, Jr. | 166/278 |
| 5,330,003 | A | * | 7/1994 | Bullick | 166/278 |
| 5,409,061 | A | * | 4/1995 | Bullick | 166/278 |
| 5,934,376 | A | * | 8/1999 | Nguyen et al. | 166/278 |

OTHER PUBLICATIONS

S.P.E. Paper #56778; "New Concentric Annular Packing System Limits Bridging in Horizontal Gravel Packs", LaFontaine et al., Oct. 1999.*

* cited by examiner

*Primary Examiner*—David Bagnell
*Assistant Examiner*—Brian Halford
(74) *Attorney, Agent, or Firm*—Robert A. Kent; Peter V. Schroeder

(57) ABSTRACT

Improved methods and apparatus for completing wells and gravel packing an interval of a wellbore are provided. The methods include the steps of placing a perforated shroud having an internal sand screen disposed therein in the zone, and injecting particulate material into the annuli between the sand screen and the perforated shroud and the perforated shroud and the wellbore to thereby form packs of particulate material therein to prevent the migration of fines and sand with produced fluids. The perforated shroud has a flow-controlling means for restricting fluid movement between the casing/shroud and shroud/screen annuli during gravel packing. The flow-controlling means may be comprised of a material installed on a selected number of the shroud perforations which blocks or partially blocks fluid flow through the otherwise permeable wall of the perforated shroud during gravel packing. Preferably, the material is removable after the gravel has been placed, such as by melting or dissolving, to accommodate production flow during the production phase without restriction. Materials suitable for application in the improved methods include magnesium oxide/magnesium chloride/calcium carbonate mixtures, oil soluble resins, waxes, soluble polymers, etc. Other suitable materials employ other mechanisms such as temperature, oil solubility, internal breaker or flow shear stress to remove them.

28 Claims, 5 Drawing Sheets

METHODS AND APPARATUS FOR IMPROVING PERFORMANCE OF GRAVEL PACKING SYSTEMS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

TECHNICAL FIELD

This invention relates to improved methods and apparatus for completing wells in unconsolidated subterranean zones, and more particularly, to improved methods and apparatus for completing such wells whereby the migration of fines and sand with the fluids produced therefrom is prevented.

BACKGROUND OF THE INVENTION

Oil and gas wells are often completed in unconsolidated formations containing loose and incompetent fines and sand which migrate with fluids produced by the wells. The presence of formation fines and sand in the produced fluids is disadvantageous and undesirable in that the particles abrade pumping and other producing equipment and reduce the fluid production capabilities of the producing zones in the wells.

Heretofore, unconsolidated subterranean zones have been stimulated by creating fractures in the zones and depositing particulate proppant material in the fractures to maintain them in open positions. In addition, the proppant has heretofore been consolidated within the fractures into hard permeable masses to reduce the migration of formation fines and sands through the fractures with produced fluids. Further, gravel packs which include sand screens and the like have commonly been installed in the wellbores penetrating unconsolidated zones. The gravel packs serve as filters and help to assure that fines and sand do not migrate with produced fluids into the wellbores.

In a typical gravel pack completion, a screen is placed in the wellbore and positioned within the unconsolidated subterranean zone which is to be completed. The screen is typically connected to a tool which includes a production packer and a cross-over, and the tool is in turn connected to a work or production string. A particulate material, which is usually graded sand, often referred to in the art as gravel, is pumped in a slurry down the work or production string and through the cross over whereby it flows into the annulus between the screen and the wellbore. The liquid forming the slurry leaks off into the subterranean zone and/or through the screen which is sized to prevent the sand in the slurry from flowing therethrough. As a result, the sand is deposited in the annulus around the screen whereby it forms a gravel pack. The size of the sand in the gravel pack is selected such that it prevents formation fines and sand from flowing into the wellbore with produced fluids.

A problem which is often encountered in forming gravel packs, particularly gravel packs in long and/or deviated unconsolidated producing intervals, is the formation of sand bridges in the annulus. That is, non-uniform sand packing of the annulus between the screen and the wellbore often occurs as a result of the loss of carrier liquid from the sand slurry into high permeability portions of the subterranean zone which in turn causes the formation of sand bridges in the annulus before all the sand has been placed. The sand bridges block further flow of the slurry through the annulus which leaves voids in the annulus. When the well is placed on production, the flow of produced fluids is concentrated through the voids in the gravel pack which soon causes the screen to be eroded and the migration of fines and sand with the produced fluids to result.

Incomplete packing of the interval may be caused by the liquid in the gravel slurry flowing into more permeable strata in the upper end of the formation interval and/or through the openings in the upper portion of the screen before sufficient gravel has been transported to the bottom of the completion interval.

In attempts to prevent the formation of sand bridges in gravel pack completions, special screens having internal shunt tubes have been developed and used. While such screens have achieved varying degrees of success in avoiding sand bridges, they, along with the gravel packing procedure, are very costly.

U.S. Pat. No. 4,945,991, which is incorporated herein by reference, discloses methods for gravel packing an interval of a wellbore wherein perforated shunts or conduits are provided on the external surface of the screen which are in fluid communication with the gravel slurry as it enters the annulus in the wellbore adjacent the screen. This method does not prevent the formation of such bridges where the liquid from the slurry is lost to the upper part of the gravel pack screen.

U.S. Pat. No. 5,934,376, which is incorporated herein by reference, discloses a method, basically comprising the steps of placing a slotted liner or perforated shroud with an internal sand screen disposed therein, in the zone to be completed, isolating the perforated shroud and the wellbore in the zone and injecting particulate material into the annuli between the sand screen and the perforated shroud and the wellbore to thereby form packs of particulate material therein. The system enables the fluid and sand to bypass any bridges that may form by providing multiple flowpaths via the perforated shroud/screen annulus and/or wellbore/screen annulus. See also Lafontaine, et al.: "New Concentric Annular Packing System Limits Bridging in Horizontal Gravel Packs," paper 56778 presented at the 1999 SPE Annual Technical Conference and Exhibition held in Houston, Tex., October 3–6, which is incorporated herein by reference.

U.S. Pat. No. 5,165,476, which is incorporated herein by reference, discloses a method and apparatus for gravel packing an interval of a wellbore wherein a permeable screen having a means for restricting fluid flow from the screen-wellbore annulus into the upper portions of the screen is positioned adjacent the wellbore interval. The flow-restrictive means may be comprised of a material which remains substantially solid during circulation of the gravel slurry but preferably can be removed, e.g., by melting or dissolving, after the gravel has been placed. However, this method does not provide multiple flow-paths, or prevent the problem of premature liquid loss from the gravel slurry to the upper end of the formation interval.

Thus, there are needs for improved methods and apparatus for completing wells in unconsolidated subterranean zones whereby the migration of formation fines and sand with produced fluids can be economically and permanently prevented while allowing the efficient production of hydrocarbons from the unconsolidated producing zone.

SUMMARY

The present invention provides improved methods and apparatus for completing wells, and optionally simultaneously fracture stimulating the wells, in unconsolidated subterranean zones which meet the needs described above and overcome the deficiencies of the prior art.

The improved methods include the steps of placing a perforated shroud having an internal sand screen disposed therein whereby an annulus is formed between the sand screen and the perforated shroud in an unconsolidated subterranean zone, and injecting particulate material into the annulus between the sand screen and the perforated shroud and into the zone by way of the perforated shroud. Fluid flow from the shroud-screen annulus out through the upper portions of the perforated shroud is restricted during the gravel placement to prevent premature liquid loss to the upper end of the formation interval.

To improve the performance of the system in reducing the potential of screen-out or forming sand bridges inside the shroud-screen annulus, the number of holes or perforations on the shroud is decreased to an optimized number during the gravel packing operation. However, the number of holes on the shroud is preferably increased during the production phase to accommodate production flow without restriction.

A method of preparing perforations on a shroud is included wherein a number of perforations on the shroud is selected to be installed with screen or filter medium plate. The screen/filter plate can either be threaded or welded to the shroud so that it covers the perforations. The screen/filter is then coated or plated with a layer of dissolvable, meltable or erodable material to completely shut off the flow. After the placement of gravel in the wellbore, the material is removed from the screen/filter, allowing perforations to open up for more flow paths during production of the well.

Materials suitable for application in the improved methods include magnesium oxide/magnesium chloride/calcium carbonate mixtures, oil soluble resins, waxes, soluble polymers, etc. In one example, a paste form of a magnesium oxide/magnesium chloride/calcium carbonate mixture is put on the screen/filter plates, and allowed to cure before installation of the perforated shroud system down hole. After the gravel placement, a flush of weak HCl is applied into the wellbore and allowed to soak through the gravel pack. The coated material on the screen/filter plates is thereby removed.

Other suitable materials employ other mechanisms such as temperature, oil solubility, internal breaker or flow shear stress to remove them from the plates. Other methods such as using ceramic discs to cover the perforations and relying on explosive charges or sonic waves to rupture or break up the discs are also applicable.

During circulation of the gravel slurry, the flow of liquid from the slurry through the upper portions of the perforated shroud is restricted so that there is little, if any, premature liquid loss through the upper portions of the perforated shroud, thereby reducing the possibility of sand bridges being formed in the annulus. After the gravel has been deposited around the screen, fluid flow is re-established through substantially the full length of the perforated shroud.

The permeable pack of particulate material formed prevents the migration of formation fines and sand with fluids produced into the wellbore from the unconsolidated zone.

The unconsolidated formation can be fractured prior to or during the injection of the particulate material into the unconsolidated producing zone, and the particulate material can be deposited in the fractures as well as in the annuli between the sand screen and the slotted liner and between the slotted liner and the wellbore.

The apparatus of this invention include a perforated shroud having an internal sand screen disposed therein whereby an annulus is formed between the sand screen and the perforated shroud, a cross-over adapted to be connected to a production string attached to the perforated shroud and sand screen and a production packer attached to the cross-over. The perforated shroud has means for restricting fluid movement between the casing/shroud and shroud/screen annulus, including decreasing or increasing the number or size of holes or perforations on the shroud during gravel placement and during the production phase.

The improved methods and apparatus of this invention avoid the formation of sand bridges in the annulus between the slotted liner and the wellbore thereby producing a very effective sand screen for preventing the migration of fines and sand with produced fluids.

It is, therefore, a general object of the present invention to provide improved methods of completing wells in unconsolidated subterranean zones.

Other and further objects, features and advantages of the present invention will be readily apparent to those skilled in the art upon a reading of the description of preferred embodiments which follows when taken in conjunction with the accompanying drawings.

DETAILED DESCRIPTION OF THE INVENTION

The present invention provides improved methods and apparatus for completing, and optionally simultaneously fracture stimulating, a subterranean zone penetrated by a wellbore. The methods can be performed in either vertical, deviated or horizontal wellbores which are open-hole and/or underreamed, or have casing cemented therein. If the method is to be carried out in a cased wellbore, the casing is perforated to provide for fluid communication with the zone. Since the present invention is applicable in horizontal and inclined wellbores, the terms "upper" and "lower,""top" and "bottom," as used herein are relative terms and are intended to apply to the respective positions within a particular wellbore, while the term "levels" is meant to refer to respective spaced positions along the wellbore. The terms "perforated shroud" and "slotted liner" are used interchangeably throughout this invention.

Figure 1:
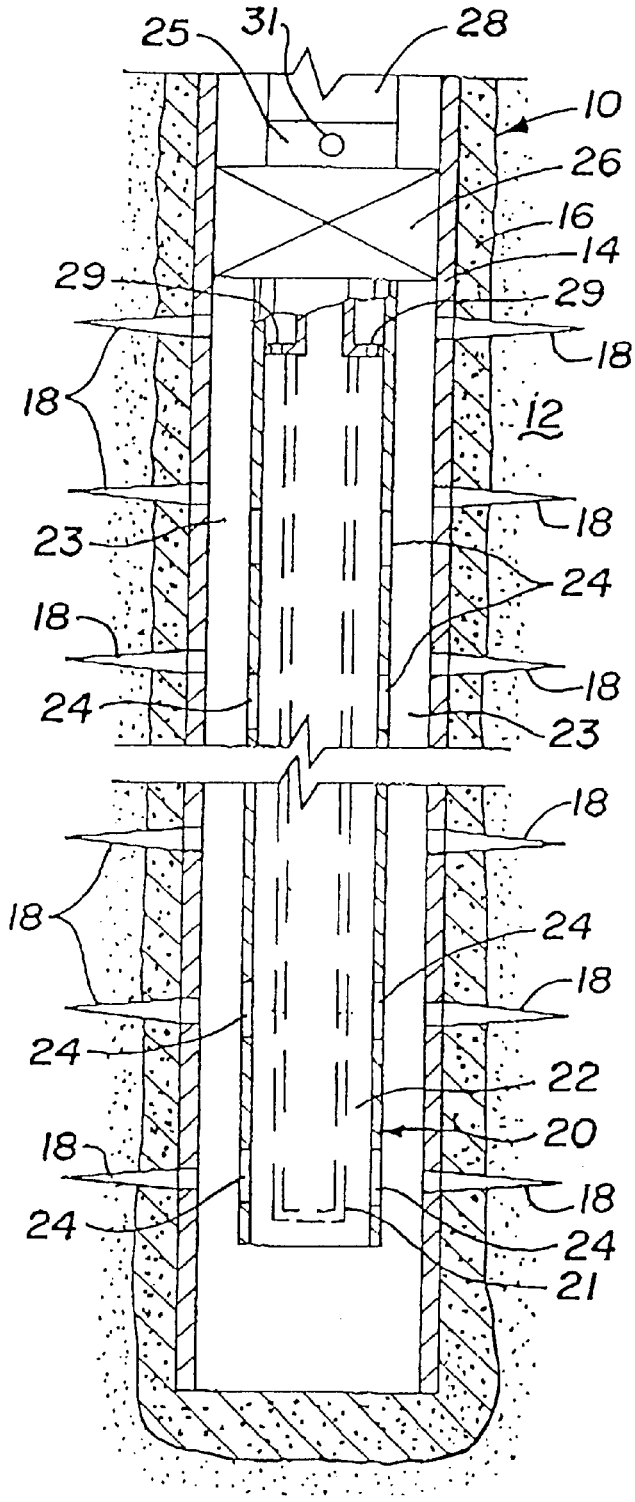
FIG. 1 is a side-cross sectional view of a wellbore penetrating an unconsolidated subterranean producing zone having casing cemented therein and having a slotted liner with an internal sand screen, a production packer and a cross-over connected to a production string disposed therein.
Figure 2:
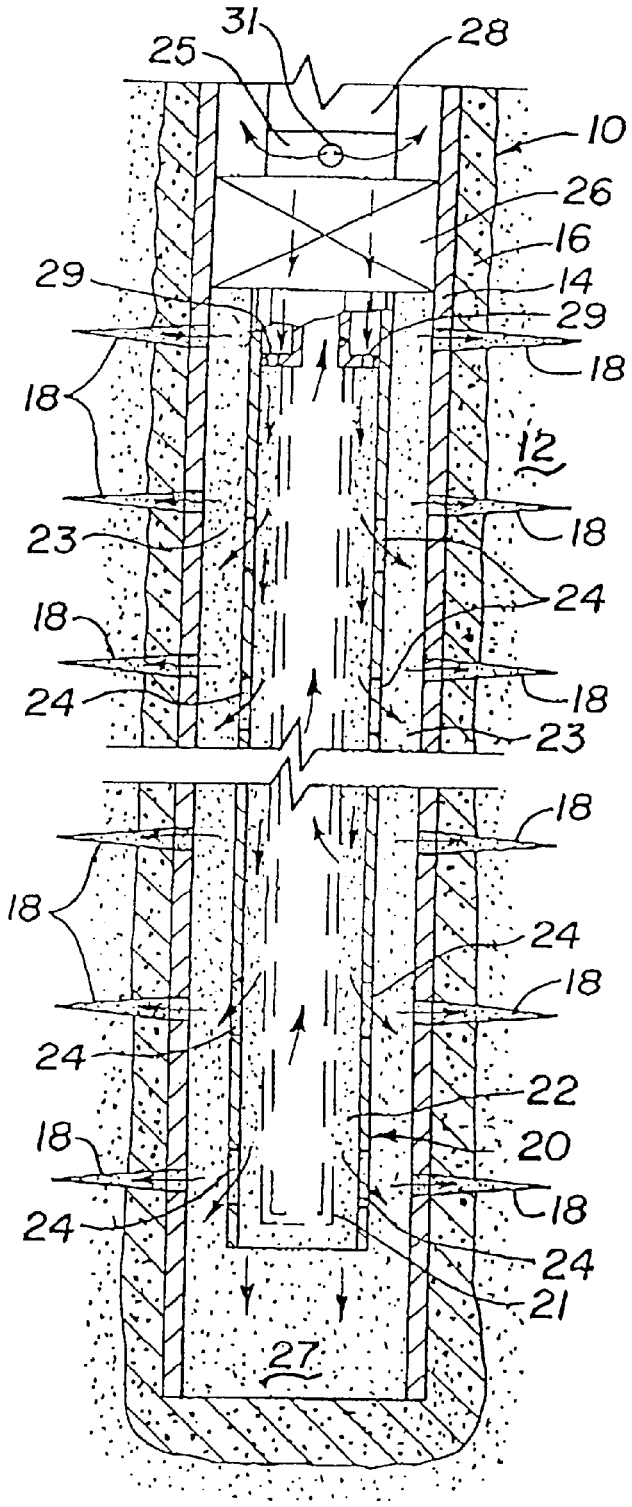
FIG. 2 is a side cross sectional view of the wellbore of FIG. 1 after particulate material has been packed therein.
Figure 3:
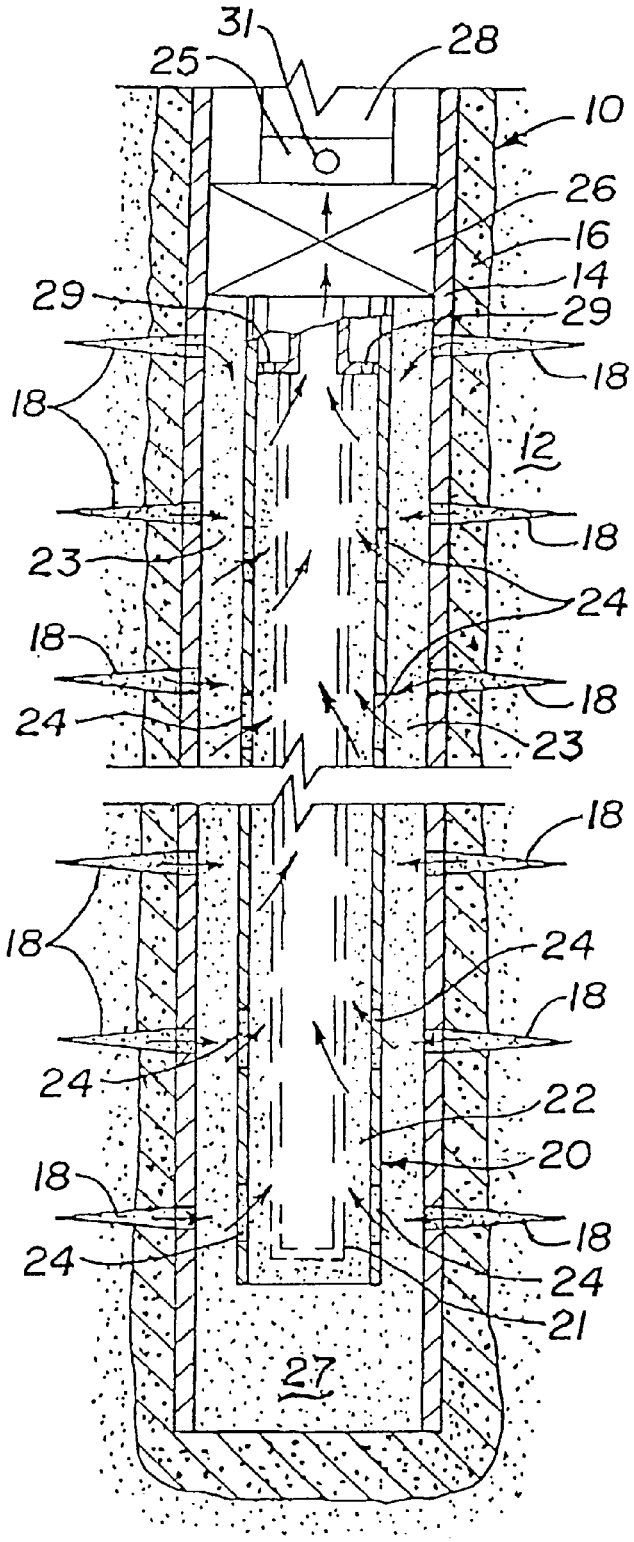
FIG. 3 is a side cross sectional view of the wellbore of FIG. 1 after the well has been placed on production.

Referring now to the drawings and particularly to FIGS. 1–3, a vertical wellbore 10 having casing 14 cemented therein is illustrated extending into an unconsolidated subterranean zone 12. The casing 14 is bonded within the wellbore 10 by a cement sheath 16. A plurality of spaced perforations 18 produced in the wellbore 10 utilizing conventional perforating gun apparatus extend through the casing 14 and cement sheath 16 into the unconsolidated producing zone 12.

In accordance with the methods of the present invention a perforated shroud comprised of slotted liner 20 having an internal sand screen 21 installed therein whereby an annulus 22 is formed between the sand screen 21 and the perforated shroud 20 is placed in the wellbore 10. The perforated shroud 20 and sand screen 21 have lengths such that they substantially span the length of the producing interval in the wellbore 10. The perforated shroud is of a diameter such that when it is disposed within the wellbore 10 an annulus 23 is formed between it and the casing 14. The slots or perforations 24 in the perforated shroud can be circular as illustrated in the drawings, or they can be rectangular or other shape. Generally, when circular slots are utilized they are at least ¼" in diameter, and when rectangular slots are utilized they are at least 3⁄16" wide by ½" long.

The term "screen" is used generically herein and is meant to include and cover any and all types of permeable structures commonly used by the industry in gravel pack operations which permit flow of fluids therethrough while blocking the flow of particulates (e.g., commercially-available screens, slotted or perforated liners or pipes, screened pipes, pre-packed screens, expandable-type screens and/or liners, or combinations thereof). Screen 21 can be of one continuous length or it may consist of sections (e.g., 30 foot sections) connected together.

As shown in FIGS. 1–3, the perforated shroud 20 and sand screen 21 are connected to a cross-over 25 which is in turn connected to a production string 28. A production packer 26 is attached to the cross-over 25. The cross-over 25 and production packer 26 are conventional gravel pack forming tools and are well known to those skilled in the art. The cross-over 25 is a sub-assembly which allows fluids to follow a first flow pattern whereby particulate material suspended in a slurry can be packed in the annuli between the sand screen 21 and the perforated shroud 20 and between the perforated shroud 20 and the wellbore 10. As shown by the arrows in FIG. 2, the particulate material suspension flows from inside the production string 28 to the annulus 22 between the sand screen 21 and perforated shroud 20 by way of two or more ports 29 in the cross-over 25. Simultaneously, fluid is allowed to flow from inside the sand screen 21 upwardly through the cross-over 25 to the other side of the packer 26 outside of the production string 28 by way of one or more ports 31 in the cross-over 25. By pipe movement or other procedure, flow through the cross-over 25 can be selectively changed to a second flow pattern (shown in FIG. 3) whereby fluid from inside the sand screen 20 flows directly into the production string 28 and the ports 31 are shut off. The production packer 26 is set by pipe movement or other procedure whereby the annulus 23 is sealed.

After the perforated shroud 20 and sand screen 21 are placed in the wellbore 10, the annulus 23 between the perforated shroud 20 and the casing 14 is isolated by setting the packer 26 in the casing 14 as shown in FIG. 1. Thereafter, as shown in FIG. 2, a slurry of particulate material 27 is injected into the annulus 22 between the sand screen 21 and the perforated shroud 20 by way of the ports 29 in the cross-over 25 and into the annulus 23 between the perforated shroud 20 and the casing 14 (or wellbore wall) by way of the slots 24 in the perforated shroud 20. The slurry can also flow directly into annulus 23 between the perforated shroud 20 and the casing 14 (or wellbore wall) after exiting the cross-over ports 31.

The particulate material flows into the perforations 18 and fills the interior of the casing 14 below the packer 26 except for the interior of the sand screen 21. As shown in FIG. 2, a carrier liquid slurry of the particulate material 27 is pumped from the surface through the production string 28 and through the cross-over 25 into annulus 22 between the sand screen 21 and the perforated shroud 20. From the annulus 22, the slurry flows through the slots 24 and through the open end of the perforated shroud 20 into the annulus 23 and into the perforations 18. The carrier liquid in the slurry leaks off through the perforations 18 into the unconsolidated zone 12 and through the screen 21 from where it flows through cross-over 25 and into the casing 14 above the packer 26 by way of the ports 31.

After the particulate material has been packed into the wellbore 10, the well is returned to production as shown in FIG. 3. The pack of particulate material 27 formed filters out and prevents the migration of formation fines and sand with fluids produced into the wellbore from the unconsolidated subterranean zone 12.

Figure 4:
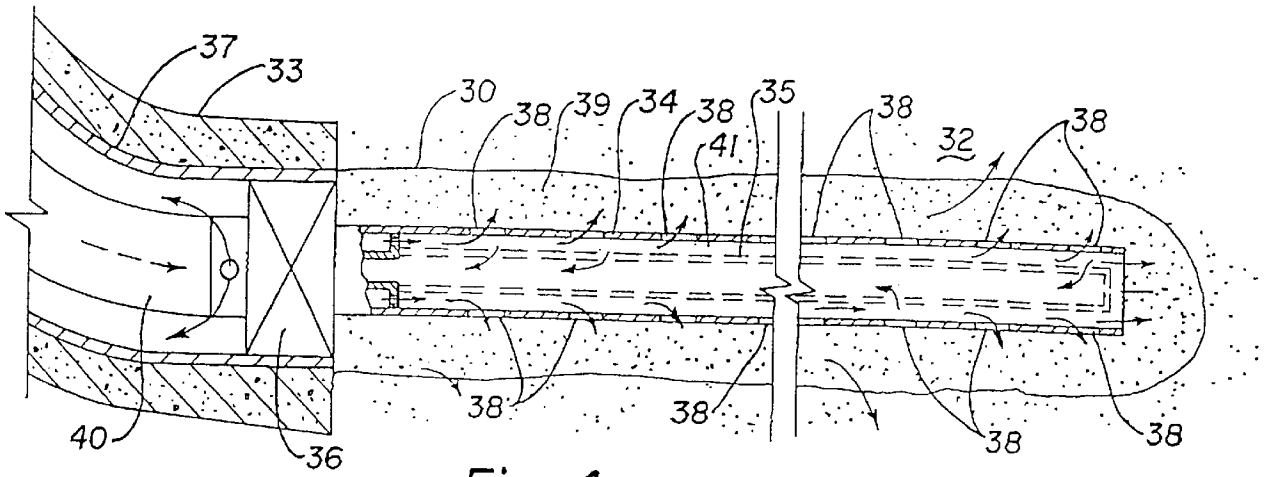
FIG. 4 is a side cross sectional view of a horizontal open-hole wellbore penetrating an unconsolidated subterranean producing zone having a slotted liner with an internal sand screen, a production packer and a cross-over connected to a production string disposed therein.
Figure 5:
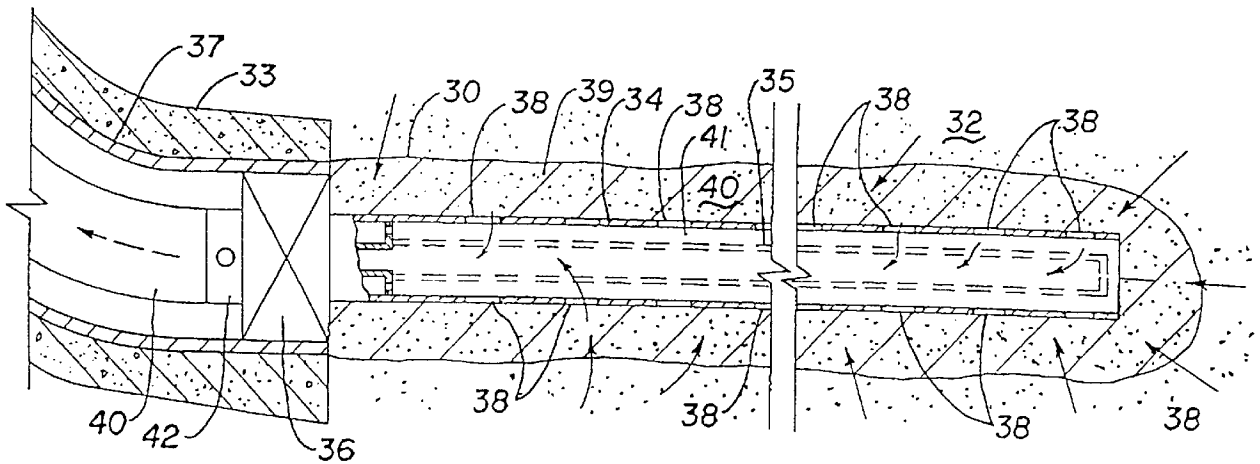
FIG. 5 is a side cross sectional view of the horizontal open hole wellbore of FIG. 4 after particulate material has been packed therein.

Referring now to FIGS. 4 and 5, a horizontal open-hole wellbore 30 is illustrated. The wellbore 30 extends into an unconsolidated subterranean zone 32 from a cased and cemented wellbore 33 which extends to the surface. As described above in connection with the wellbore 10, a perforated shroud 34 having an internal sand screen 35 disposed therein whereby an annulus 41 is formed therebetween is placed in the wellbore 30. The perforated shroud 34 and sand screen 35 are connected to a cross-over 42 which is in turn connected to a production string 40. A production packer 36 is connected to the cross-over 42 which is set within the casing 37 in the wellbore 33.

In carrying out the methods of the present invention for completing the unconsolidated subterranean zone 32 penetrated by the open-hole wellbore 30, the perforated shroud 34 with the sand screen 35 therein is placed in the wellbore 30 as shown in FIG. 4. The annulus 39 between the perforated shroud 34 and the wellbore 30 is isolated by setting the packer 36. Thereafter, a slurry of particulate material is injected into the annulus 41 between the sand screen 35 and the perforated shroud 34, and by way of the slots 38 into the annulus 39 between the perforated shroud 34 and the wellbore 30. The slurry can also flow directly into annulus 23 between the perforated shroud 20 and the wellbore wall 30 after existing the cross-over parts 31.

The pack of particulate material 40 formed filters out and prevents the migration of formation fines and sand with fluids produced into the wellbore 30 from the subterranean zone 32.

In accordance with the present invention, perforated shroud 20 includes a means for restricting fluid movement between the casing/shroud and shroud/screen annuli by decreasing or increasing the number or size of holes or perforations on the shroud during gravel placement and during the production phase. Perforation size and number of perforations in the shroud will affect fluid movement between the casing/shroud and shroud/screen annuli. The casing/shroud and shroud/screen annuli act as one annulus if there is an unlimited number of relatively large perforations in the shroud. A relatively small pressure differential will develop as the number of perforations and/or perforation diameter is reduced. By continuing to reduce the number of perforations and/or perforation diameter, we can control, to some extent, movement of fluid between the annuli. The slurry will continue to flow down the parallel annuli until a sand bridge or other well bore condition causes an abnormal pressure loss in one of the annuli. Once the pressure rises above that required to force flow through the perforations and the friction pressure in the annulus remaining open to flow, the slurry will reapportion itself to the annulus open to flow. As an illustration, by restricting fluid flow through the upper portions of the perforated shroud while allowing substantially unrestricted fluid flow through the lower portions thereof, no substantial amount of liquid from the gravel slurry is lost prematurely through the upper portions of the perforated shroud. This results in the slurry continuing to the bottom of the well before the gravel is separated from the liquid in the slurry. The separated liquid flows through the lower permeable portions of the perforated shroud and/or through perforations 18 thereby depositing gravel at the bottom of the well. As the annulus of wellbore and perforated shroud and the annulus of perforated shroud and screen fills with gravel from the bottom up, the liquid in the slurry will continue to separate from the gravel and flow through the available perforations 18 in the casing and/or downward through the gravel which has already been deposited in the annuli and through the lower permeable portions of the perforated shroud 20 to complete the gravel placement.

Figure 6:
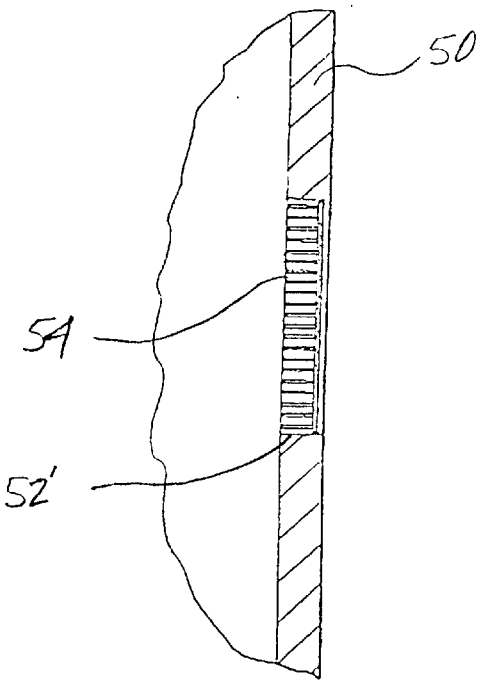
FIG. 6 is a broken-away view, partly in section, showing a sample perforation on a shroud installed with a screen or filter medium plate and a soluble or removable material coated on the screen/filter plate in accordance with the present invention.
Figure 7:
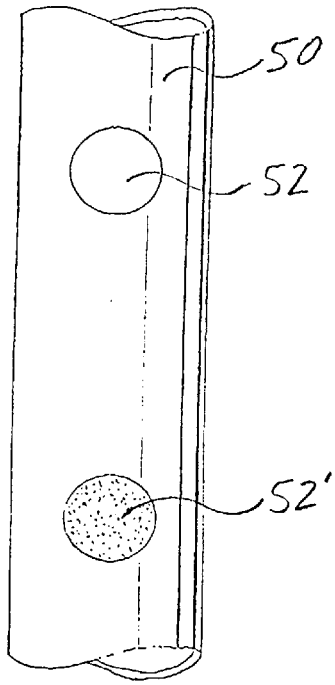
FIG. 7 is a broken-away view taken from outside the shroud, illustratively showing a sample perforation on the shroud with the blocking material installed and another perforation open to flow.
Figure 8:
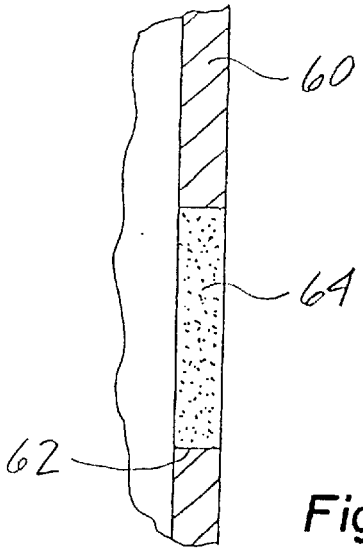
FIG. 8 is similar to FIG. 6 but showing the blocking material installed in the perforations on the shroud directly without use of a screen/filter plate.

The means for restricting fluid movement between the casing/shroud and shroud/screen annuli 20 may be comprised of any material installed on a selected number of the shroud perforations which blocks or partially blocks fluid flow through the otherwise permeable wall of the perforated shroud. In the embodiment of FIGS. 6 and 7, a selected number of the perforations 52 (only one shown, designated as 52') on perforated shroud 50 are installed with a screen or filter medium plate 54. The screen/filter plate 54 is threaded or welded to the shroud 50 so that it covers the desired number of perforations 52. The screen/filter 54 is then coated or plated with a layer of dissolvable, meltable or erodable material 56 to completely shut off the flow. Other materials such as ceramic plate which can be broken up afterward by explosive charges or sonic waves can also apply. After the placement of gravel in the wellbore, the blocking material 56 is completely removed from the screen/filter 54, allowing the perforations to open up for more flow paths. FIG. 8 shows an alternative method where blocking material 64 is installed in slots 62 of perforated shroud 60 directly without use of a screen/filter plate.

As an example of materials which can be used, a paste form of a magnesium oxide/magnesium chloride/calcium carbonate mixture can be put on the screen/filter plates, and allowed to cure before installation of the perforated shroud system down hole. After the gravel placement a flush of weak hydrochloric acid is applied into the wellbore and allowed to soak through the gravel pack, removing the coated material on the screen/filter plates. One specific formulation which has been developed is comprised of a mixture of 40 Pbw (Parts by weight) of calcined magnesium oxide (MgO), 67 Pbw of $MgCl_2 \cdot 6H_2O$ (magnesium chloride hexahydrate), 25 Pbw of calcium carbonate ($CaCO_3$), and 30 Pbw of potable tap water (no brines). This material has been found to require a one day cure time at ambient temperature. After use, it rapidly dissolves in inhibited hydrochloric acid; for example, 1-inch "plugs" of the material have completely dissolved in ten minutes at 72° F.

The methods and apparatus of this invention are particularly suitable and beneficial in forming gravel packs in long-interval horizontal wellbores without the formation of sand bridges. Because elaborate and expensive sand screens including shunts and the like are not required and the pack sand does not require consolidation by a hardenable resin composition, the methods of this invention are very economical as compared to prior art methods.

The creation of one or more fractures in the unconsolidated subterranean zone to be completed in order to stimulate the production of hydrocarbons therefrom is well known to those skilled in the art. The hydraulic fracturing process generally involves pumping a viscous liquid containing suspended particulate material into the formation or zone at a rate and pressure whereby fractures are created therein. The continued pumping of the fracturing fluid extends the fractures in the zone and carries the particulate material into the fractures. The fractures are prevented from closing by the presence of the particulate material therein.

The subterranean zone to be completed can be fractured prior to or during the injection of the particulate material into the zone, i.e., the pumping of the carrier liquid containing the particulate material through the perforated shroud into the zone. Upon the creation of one or more fractures, the particulate material can be pumped into the fractures as well as into the perforations in the casing (for cased wells) and into the annuli between the sand screen and perforated shroud and between the perforated shroud and the wellbore.

Thus, the present invention is well adapted to carry out the objects and attain the ends and advantages mentioned as well as those which are inherent therein. While numerous changes may be made by those skilled in the art, such changes are included in the spirit of this invention as defined by the appended claims.

What is claimed is:

1. A method of completing a subterranean zone penetrated by a wellbore comprising the steps of:

(a) placing in said wellbore in said zone a perforated shroud having an internal sand screen disposed therein whereby a first annulus is formed between said sand screen and said perforated shroud and a second annulus is formed between said perforated shroud and said wellbore;

(b) injecting particulate material into said second annulus between said perforated shroud and said wellbore and into said first annulus between said sand screen and said perforated shroud, the particulate material flowing through at least some of the perforations in said perforated shroud; and (c) blocking a selected number of perforations in the shroud, thereby restricting fluid flow between said first and second annuli while said particulate material is flowing through said first and second annuli; and (d) unblocking the blocked perforations in the shroud, thereby increasing the number of perforations available for fluid flow.

2. The method of claim 1 wherein said particulate material is sand proppant.

3. The method of claim 1 wherein said particulate material is manmade proppant.

4. The method of claim 1 wherein said wellbore in said subterranean zone is open-hole.

5. The method of claim 1 wherein said wellbore in said subterranean zone has casing cemented therein with perforations formed through the casing and cement.

6. The method of claim 1 wherein said wellbore in said zone is horizontal.

7. The method of claim 1 which further comprises the step of creating at least one fracture in said subterranean zone prior to or while carrying out the injecting step.

8. The method of claim 7 which further comprises the step of depositing particulate material in said fracture.

9. The method of claim 1 which further comprises the step of placing said subterranean zone in production.

10. The method of claim 1 wherein the number of perforations on said perforated shroud is blocked by providing a dissolvable material adjacent a selected number of said perforations.

11. The method of claim 1 which further comprises the step of increasing the flow capacity of said perforated shroud after said particulate material is packed in said first and second annuli.

12. The method of claim 1 wherein the step of unblocking the blocked perforations is performed while the particulate matter is flowing through the annuli.

13. The method of claim 1 wherein the step of injecting particulate matter further comprises flowing particulate matter from the first annulus to the second annulus.

14. The method of claim 1 wherein the step of injecting particulate matter further comprises flowing particulate matter from the second annulus into the first annulus.

15. The method of claim 1 further comprising the step of placing a cross-over tool into the wellbore, the cross-over tool providing fluid communication from above the tool to the first annulus.

16. The method of claim 1 wherein the step of blocking a number of perforations further comprises placing a filter medium plate across the perforations.

17. The method of claim 16, further comprising the step of coating the filter medium plate with a layer of removable material to substantially block flow through the perforations.

18. The method of claim 17 wherein the removable material is a mixture including magnesium oxide, magnesium chloride or calcium carbonate.

19. The method of claim 16 wherein the step of unblocking further comprises flushing the wellbore with an acid.

20. The method of claim 1 wherein the step of unblocking further comprises flushing the wellbore with an acid.

21. The method of claim 1 wherein the step of blocking further comprises placing ceramic plate over the selected perforations.

22. The method of claim 1 wherein the step of unblocking further comprises emitting sonic waves.

23. An apparatus for completing a subterranean zone penetrated by a wellbore comprising:

a perforated shroud having an internal sand screen disposed therein whereby an annulus is formed between said sand screen and said perforated shroud the shroud having an upper and a lower end;

dissolvable or breakable flow-controlling means blocking a selected number of perforations along the upper end of said perforated shroud to substantially prevent fluid flow through the selected number of perforations in said upper end of the perforated shroud; and a cross-over adapted to be attached to a workstring attached to said perforated shroud and sand screen.

24. The apparatus of claim 23 wherein said flow-controlling means is comprised of a dissolvable material which is removable by flowing a fluid which will dissolve said dissolvable material along said perforated shroud.

25. The apparatus of claim 23, wherein some of the perforations alone the upper end of the shroud are open.

26. A method for gravel packing an interval of a wellbore, said method comprising:

positioning within the wellbore adjacent said interval a perforated liner having an internal sand screen disposed therein whereby a first annulus is formed between said sand screen and said perforated liner and a second annulus is formed between said perforated liner and said wellbore;

flowing a gravel slurry down said wellbore and into said first and second annuli and said wellbore; and providing a plurality of removable plugs along said perforated liner, one in each of a selected number of the perforations, but less than all of the perforations, to decrease fluid flow between said first and second annuli while said gravel slurry is flowing through said first and second annuli; and removing the plurality of removable plugs after at least partially flowing the gravel slurry into the first and second annuli.

27. Apparatus for gravel packing an interval of a wellbore, said apparatus comprising:

a perforated liner having a plurality of perforations, an internal sand screen disposed in the liner whereby an annulus is formed between said sand screen and said perforated liner;

a flow-controlling means, one for each of a selected number, but not all, of the perforations each flow-control means blocking fluid flow through its respective perforation, the flow-control means for partially blocking fluid flow through said perforated liner during gravel packing when the apparatus is installed in said wellbore and the flow-controlling means dissolvable or rupturable to allow substantially unrestricted flow when said wellbore is placed on production.

28. The apparatus of claim 27 wherein said flow-controlling means comprises a layer of a removable material positioned adjacent a selected number of the perforations in said perforated liner.

* * * * *